US005713783A

United States Patent [19]

Szoke et al.

[11] Patent Number: 5,713,783

[45] Date of Patent: Feb. 3, 1998

[54] REMOTE CONTROLLED TOY CRASH VEHICLE APPARATUS

[76] Inventors: Anthony A. Szoke; Anthony A. Szoke, Jr., both of 523 Cedar St., W. Hempstead, N.Y. 11552

[21] Appl. No.: 601,231

[22] Filed: Feb. 14, 1996

[51] Int. Cl.[6] ..... A63H 30/04; A63H 17/02; A63H 33/22

[52] U.S. Cl. ..... 446/456; 446/6; 446/219; 446/471; 446/485

[58] Field of Search ..... 446/456, 219, 446/444, 454, 455, 470, 471, 485

[56] References Cited

U.S. PATENT DOCUMENTS

| | | | |
|---|---|---|---|
| 2,757,482 | 8/1956 | Brown . | |
| 2,803,920 | 8/1957 | Salosky . | |
| 3,581,668 | 6/1971 | Ingels | 446/454 X |
| 3,734,500 | 5/1973 | Cooper | 446/6 X |
| 4,114,312 | 9/1978 | Hendry . | |
| 4,295,292 | 10/1981 | Fitzgerald et al. | 446/6 |
| 4,306,375 | 12/1981 | Goldfarb et al. | 446/219 |
| 4,504,243 | 3/1985 | Barlow et al. | 446/444 X |
| 4,508,521 | 4/1985 | Klimpert et al. | 446/4 X |
| 4,550,910 | 11/1985 | Goldfarb et al. | 446/444 X |
| 4,559,022 | 12/1985 | Herstein et al. | 446/219 X |
| 4,588,386 | 5/1986 | Kennedy . | |
| 4,693,693 | 9/1987 | Kennedy . | |
| 4,762,511 | 8/1988 | Lee . | |
| 4,938,483 | 7/1990 | Yavetz | 446/456 X |
| 4,965,855 | 10/1990 | Tsuji | 446/485 X |
| 5,380,231 | 1/1995 | Brovelli . | |
| 5,452,901 | 9/1995 | Nakada et al. | 446/455 X |

FOREIGN PATENT DOCUMENTS

| | | | |
|---|---|---|---|
| 2421496 | 11/1975 | Germany | 446/471 |
| 3008604 | 9/1991 | Germany | 446/456 |
| 2193108 | 2/1988 | United Kingdom | 446/454 |

*Primary Examiner*—D. Neal Muir

[57] ABSTRACT

A remote controlled toy crash vehicle apparatus which upon impact with another remote controlled toy crash vehicle or obstruction simulates a crash and its consequences. The vehicle is provided with a chassis on which an interchangeable body panels support mounted, the deformable body panels affixed to the interchangeable body panels support, consisting of a front panel, left fender panel, right fender panel, left door panel(s), right door panel(s), left quarter panel, right quarter panel, hood panel, windshield panel, roof panel, rear window panel, trunk panel. All the panels could be made of deformable materials such as, but not limited to the following: aluminum, alloys, plastic etc. Also affixed to the chassis are the changeable front left, right and rear left, right turn signal lamps. Incorporated into the rear turn signals are the stop lamps. The other parts of this teaching apparatus are the interconnecting interchangeable roadway segments which represent real life road surfaces with road signs imprinted on them. The child or children can apply to the road surfaces water to create wet or icy conditions respectively, and oil to create oil spills, and powder to create dusty roads. As the children maneuver the remote controlled toy crash vehicles via the remote control devices and thus simulating a real life road traffic situation on which the children must make constant decision to avoid a possible accident and its consequences.

6 Claims, 11 Drawing Sheets

REMOTE CONTROLLED TOY CRASH VEHICLE APPARATUS

BACKGROUND OF THE INVENTION

1. Field of the Invention

This invention relates to remote controlled toy vehicles, and in particular to a toy vehicle which upon impact with another toy vehicle or object simulates a crash and its consequences.

2. Description of the Related Art 50,000 people die annually in the United States of America due to car accidents. Another 5.4 million people get injured annually in the 19.5 million car and truck accidents. The Costs of Motor Vehicle Accidents in the United States of America in 1992 according to the Statistical Abstract of the United States was $156.6 billion of which wage and productivity loss (actual loss of wages and household production, and the present value of future earnings lost) was $60.6 billion, medical expenses amounted to $20.7 billion, administrative expenses (includes the administrative cost of public and private insurance, and police and legal costs.) were $35.2 billion, motor vehicle damage amounted to $38.1 billion, and employer cost (estimate of the uninsured costs incurred by employees, representing the money value of time lost by uninsured workers) was $2 billion, and not to mention the emotional pain caused to the people and the families involved in the accidents, which can never be remunerated. The inventors hope that these numbers will be significantly reduced by use of this invention. This invention not only serves the interest of the society as a whole but also serves the interest of the government and the insurance companies. For example, if there are less car accidents, the insurance companies have lower insurance risks, and the government can pay less disability benefits to the fewer permanently disabled people due to fewer accidents.

Remote controlled toy vehicles are popular with children of all ages, for in play the child can maneuver the car and thereby imitate an adult activity. Play acting sometimes takes a destructive form in that a typical child not only enjoys operating a toy in its intended manner, but he also takes a certain delight in wrecking the toy. The dismantling of a toy does not usually reflect misbehavior on the part of the child, but an expression of natural curiosity. Thus a child who takes a toy car apart, is not trying to destroy the toy car, but is seeking to learn what makes it tick.

Play constitutes the earliest form of education, for by manipulating toys, by playing house, and by pretending to carry out various adult activities, the child acquires basic skills preparatory to more mature activity. And since in the adult world, automobiles sometimes become involved in accidents and may be wrecked, a child playing with a toy car may attempt to simulate a real car crash and deliberately crash his toy vehicle into a wall or other obstruction just to see what happens.

With a conventional toy car, the player cannot have his cake and eat it, for once this car is crashed and badly damaged, it is no longer operable. In order therefore to provide the player or players with a toy car that can be crashed without being permanently disabled, so-called crash cars have been developed and marketed. Such as U.S. Pat. No. 4,693,693 issued to Melvin R. Kennedy, Dietmar Nagel, Abraham R. Arad (1987), where the toy vehicle upon frontal impact with an obstacle simulates a car crash and its consequences.

There are a number of practical drawbacks to a crash car of this type. First, the design of the car does not allow for lateral or rear impact. And as we know accidents happen on all sides of a car.

Second, when the vehicle is crashed it does not represent a real life crash and its consequences.

Third, it does not teach the child or children the operation of the vehicle(s) on different road surfaces.

Fourth, it does not teach the child or children playing with the toy vehicle(s) the cost(s) involved in repairing the damage caused by the accident.

SUMMARY OF THE INVENTION

In the view of the foregoing, the main object of this invention is to significantly reduce the car accidents and the fatalities arising from these accidents by providing a remote controlled toy crash vehicle which upon impact with an other remote controlled toy crash vehicle or obstruction, simulates a car accident close to reality as possible without having to experience the accident from the inside of the car.

More particularly, an object of the invention is to provide a remote controlled toy crash vehicle which in the simulated crash condition imparts a crushed appearance to the side of the car that has been hit.

Another object of the invention is to teach the child or children operating the remote controlled toy crash vehicle(s) how a car behaves on different road surfaces, (e.g. wet representing wet or icy road surface, oily, and powdery or dusty representing a dusty road) and different road situations, such as curves and intersections and with different modes of accelerating and decelerating. For example, not to suddenly accelerate or decelerate on a wet or icy curved road surface.

Still another object of the invention is to teach the child or children the cost of repairing the damage caused by the accident. This can be achieved by printing the cost(s) on the inner side of each body panel, so when the child replaces the damaged panel he sees the amount(s) required for reparation.

Also another object of the invention is to teach the child or children how to signal before making a turn. Thus informing other vehicle operators of their action.

Still another object of the invention is to provide a remote controlled toy crash vehicle that can be easily converted into another type of vehicle without having to purchase an entire new vehicle. All the child have to purchase are the panels and the interchangeable body panels support and the child has a new remote controlled toy crash vehicle to play with, thus extending the play life of the toy.

Also an object of the invention is to provide a remote controlled toy crash vehicle which is relatively uncomplicated mechanical design and therefore lends itself to low cost mass production.

Briefly stated, these objects are attained in a remote controlled toy crash vehicle which upon impact with an other remote controlled toy crash vehicle or obstruction simulates a crash and its consequences on a real road surface. The remote controlled toy crash vehicle is provided with a chassis on which an interchangeable body panels support mounted, the body panels affixed to the interchangeable body panels support, consisting of a front panel, left fender panel, right fender panel, left door panel(s), right door panel(s), left quarter panel, right quarter panel, hood panel, windshield panel, roof panel, rear window panel, trunk panel. All the panels are imprinted on the inner surface with the cost(s) of reparation of damage(s). Also affixed to the chassis are the changeable front left, right and rear left, right turn signal lamps. Incorporated into the rear turn signals are the stop lamps. The other part of this teaching apparatus are the interconnecting interchangeable roadway segments which represent real life road surfaces with road signs imprinted on them. The child or children can apply to the road surfaces water to create wet or icy conditions respectively, and oil to create oil spills, and powder to create dusty roads. Thus simulating a real life road traffic situation on which the child or children must make a decision to avoid a possible accident.

DETAILED DESCRIPTION OF THE INVENTION

Figure 1:
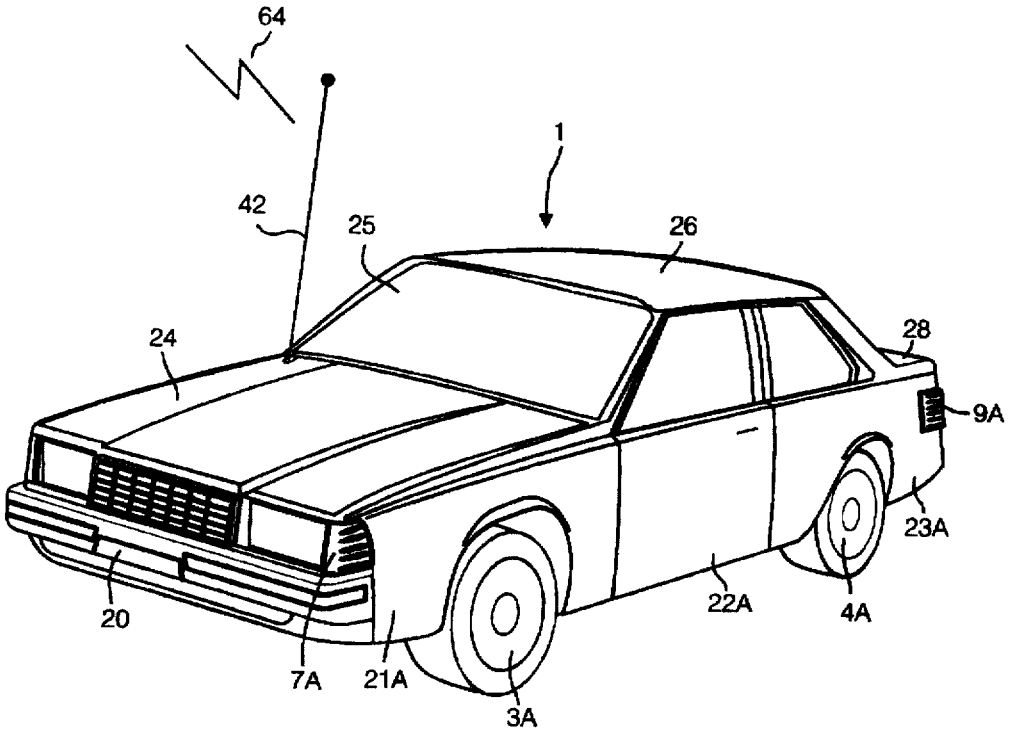
FIG. 1 is a perspective view of the remote controlled toy crash vehicle in accordance with the invention in its normal condition.

Referring now to FIG. 1, there is shown a remote controlled toy crash vehicle 1 in accordance with the invention in a preferred embodiment which takes the form of a four-wheeled, two-door sedan. It is to be understood that the invention may be embodied in various other styles such as but not limited to the following; a four-door sedan, van, minivan, pickup truck, suburban, sports car, race car, hatchback, station wagon, limousine, convertible, multi purpose vehicle, military vehicles, fantasy vehicles (e.g. bat mobile). The remote controlled toy crash vehicle 1 is designed and intended for use in conjunction with one or more similar remote controlled toy crash vehicles on simulated road surface segments as shown in FIGS. 13–18, which will be described in greater detail further on in the specifications.

Figure 2:
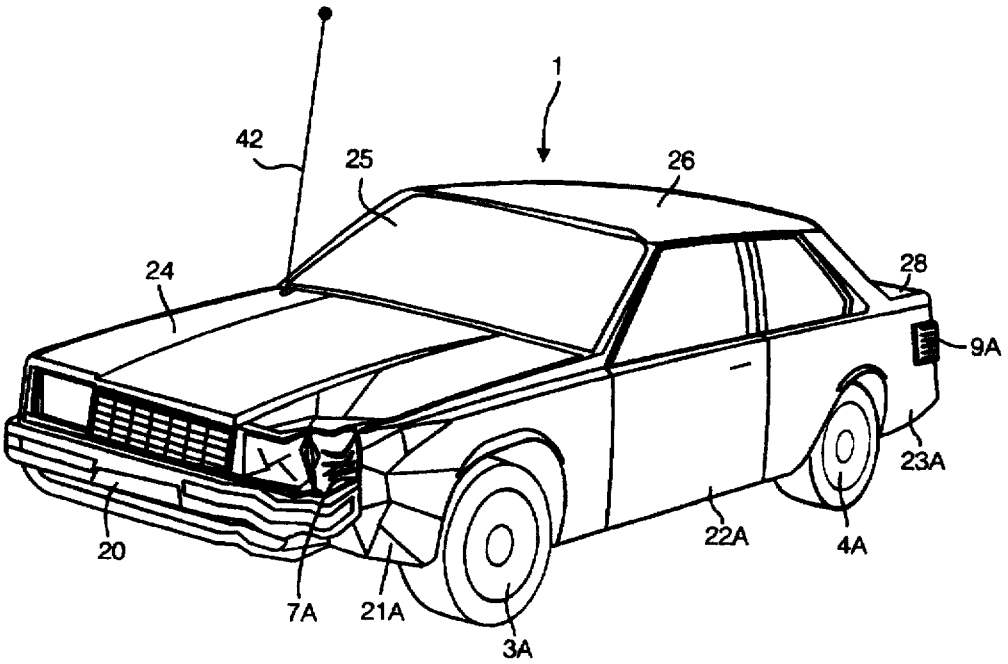
FIG. 2 shows the remote controlled toy crash vehicle, in perspective, with some of the interchangeable members deformed.

FIG. 2 depicts the remote controlled toy crash vehicle 1 in a crashed form with front panel 20, front left turn signal lamp 7A, and left fender 21A being deformed due to a collision with another remote controlled toy crash vehicle or an object.

Figure 3:
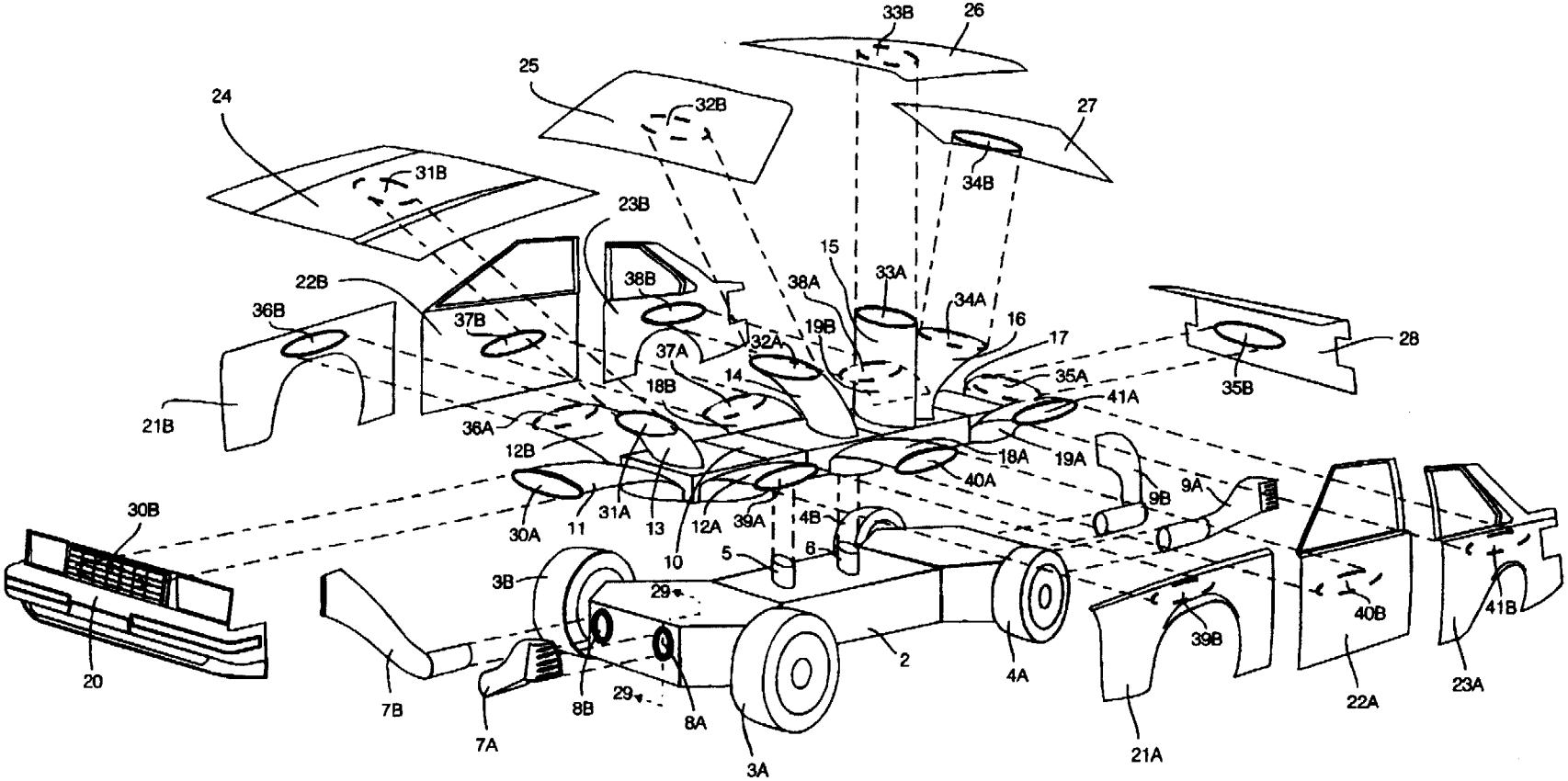
FIG. 3 is an exploded perspective view of the remote controlled toy crash vehicle.
Figure 4:
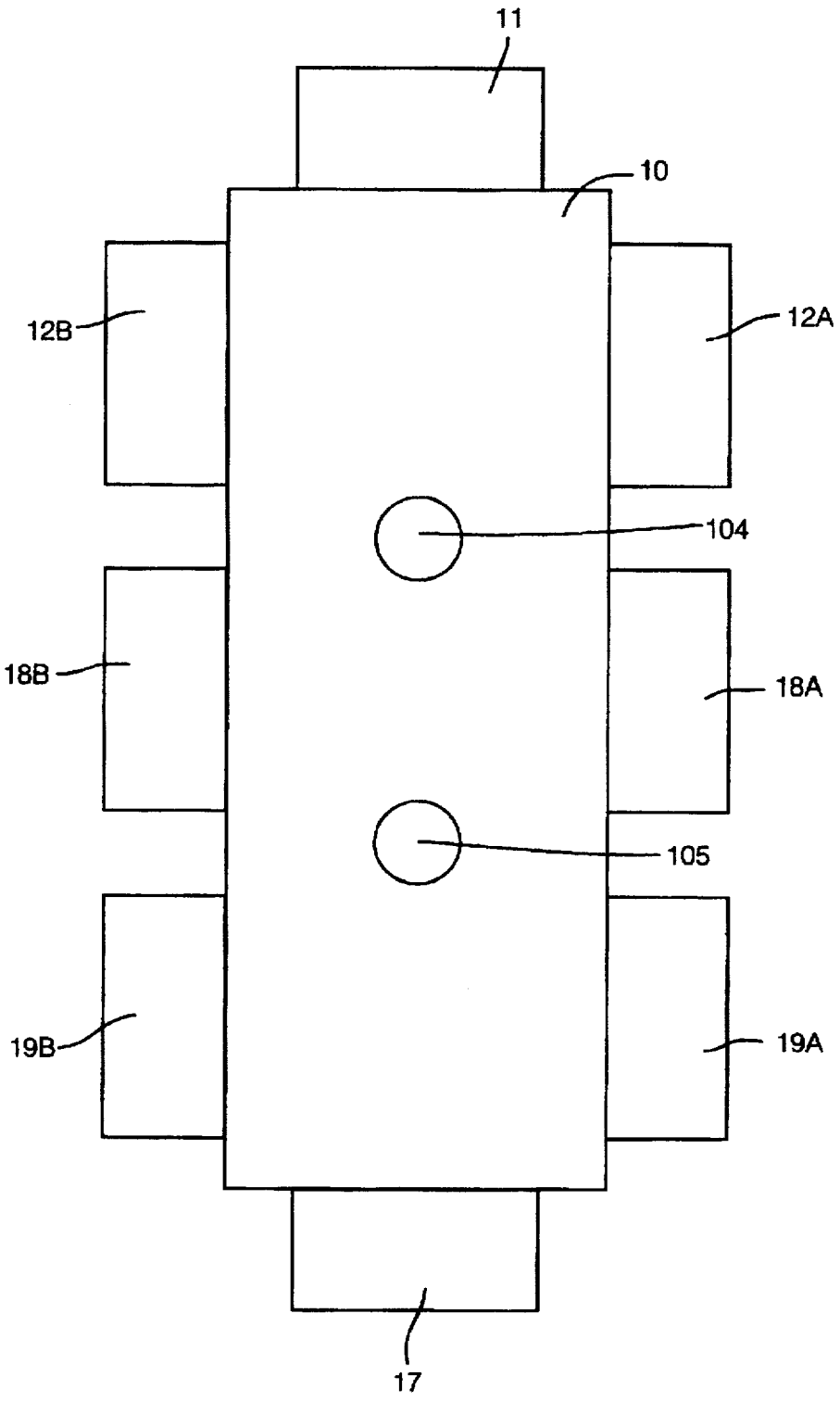
FIG. 4 is a bottom plan view of the interchangeable body panels support for the two door sedan.

As shown in FIG. 3 the remote controlled toy crash vehicle 1 includes a chassis 2 on which are supported the axles of the front wheels 3A, 3B and the rear wheels 4A, 4B and a protruding front support 5 and a protruding rear support 6. The chassis 2 is provided with front left receptacle 8A which holds the front left turn signal lamp 7A, and with front right receptacle 8B which holds the front right turn signal lamp 7B, and with rear receptacles which hold the rear left turn signal lamp/stop lamp 9A comprising of rear left turn signal lamp section 106A and rear left stop lamp section 107A; and the rear right turn signal lamp/stop lamp 9B comprising of rear right signal lamp section 106B and rear right stop lamp section 107B. Temporarily mounted on the chassis 2 is the interchangeable body panels support 10 having a front bore 104 and a rear bore 105 which is shown in FIG. 4, and further comprising of a protruding front body panel support 11 with the mounting facet 30A to which is attached the front panel 20 via mounting facet 30B, protruding left fender support 12A with the mounting facet 39A to which is attached the left fender 21A via mounting facet 39B, protruding right fender support 12B with the mounting facet 36A to which is attached the right fender 21B via mounting facet 36B, protruding hood support 13 with the mounting facet 31A to which is attached the hood 24 via mounting facet 31B, protruding windshield support 14 with the mounting facet 32A to which is attached the windshield 25 via mounting facet 32B, protruding roof support 15 with the mounting facet 33A to which is attached the roof 26 via mounting facet 33B, protruding rear window support 16 with the mounting facet 34A to which is attached the rear window 27 via mounting facet 34B, protruding trunk support 17 with the mounting facet 35A to which is attached the trunk 28 via mounting facet 35B, protruding left door support 18A with the mounting facet 40A to which is attached the left door 22A via mounting facet 40B, protruding right door support 18B with the mounting facet 37A to which is attached the right door 22B via mounting facet 37B, protruding left quarter panel support 19A with the mounting facet 41A to which is attached the left quarter panel 23A via mounting facet 41B, and protruding right quarter panel support 19B with the mounting facet 38A to which is attached the right quarter panel 23B via mounting facet 38B. All of the aforementioned mounting facets either on the interchangeable body panels support 10 or on the panels may be covered with, but not limited to the following: adhesive, Velcro, double sided tape etc.

Figure 6:
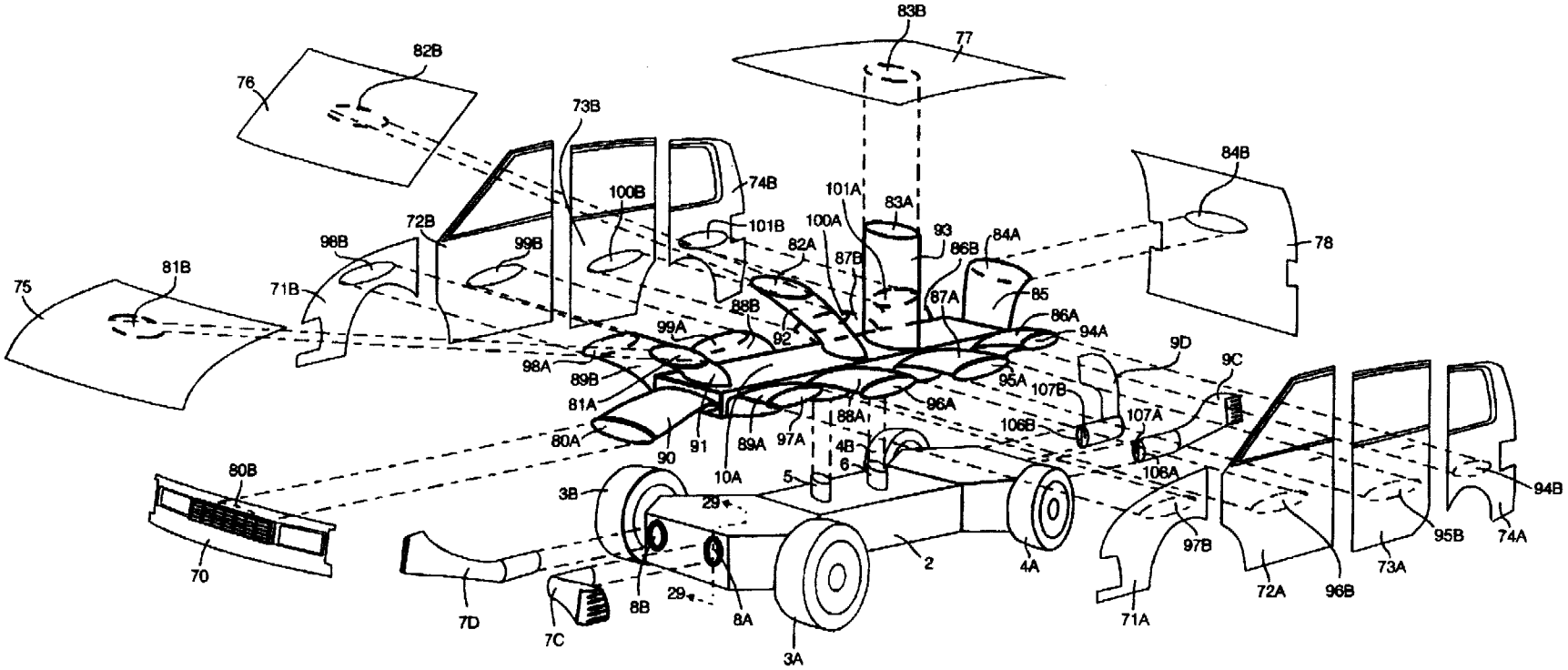
FIG. 6 is an exploded perspective view of remote controlled toy crash vehicle depicted in FIG. 5.

The underside of the interchangeable body panels support 10 as shown in FIG. 4, with front bore 104 and rear bore 105, which affixes to chassis 2, as shown in FIG. 3, via protruding front support 5 and protruding rear support 6 by means of friction, so designed that the necessary force required to change the interchangeable body panels support 10 does not exceed the force generated by a child. So the interchangeable body panels support 10 can be exchanged quickly and easily for another interchangeable body panels support thus creating a new vehicle, as shown in FIG. 6, with the same chassis 2, and performing a different part in the educational traffic game. Further more the changeable body panels could be made of deformable materials such as, but not limited to the following: aluminum, alloys, plastic etc.

Figure 5:
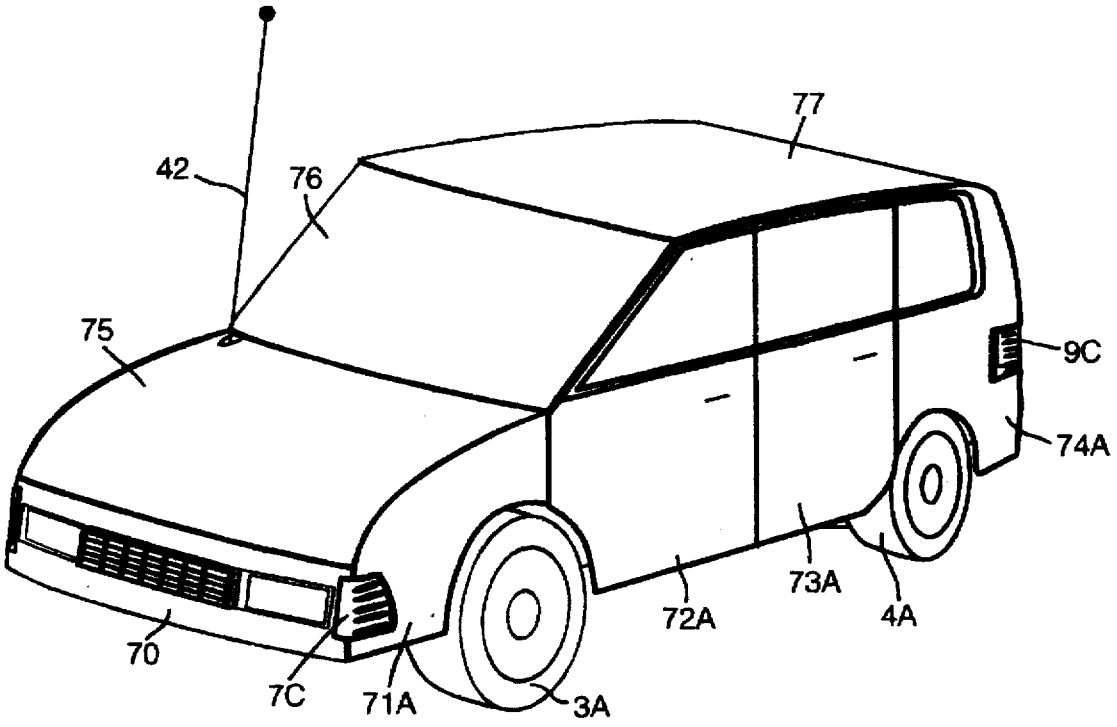
FIG. 5 is a perspective view of the remote controlled toy crash vehicle with different outer interchangeable members, but with same chassis.

An other version of the remote controlled toy crash vehicle shown in FIG. 5, in the form of a minivan in its normal condition.

Figure 7:
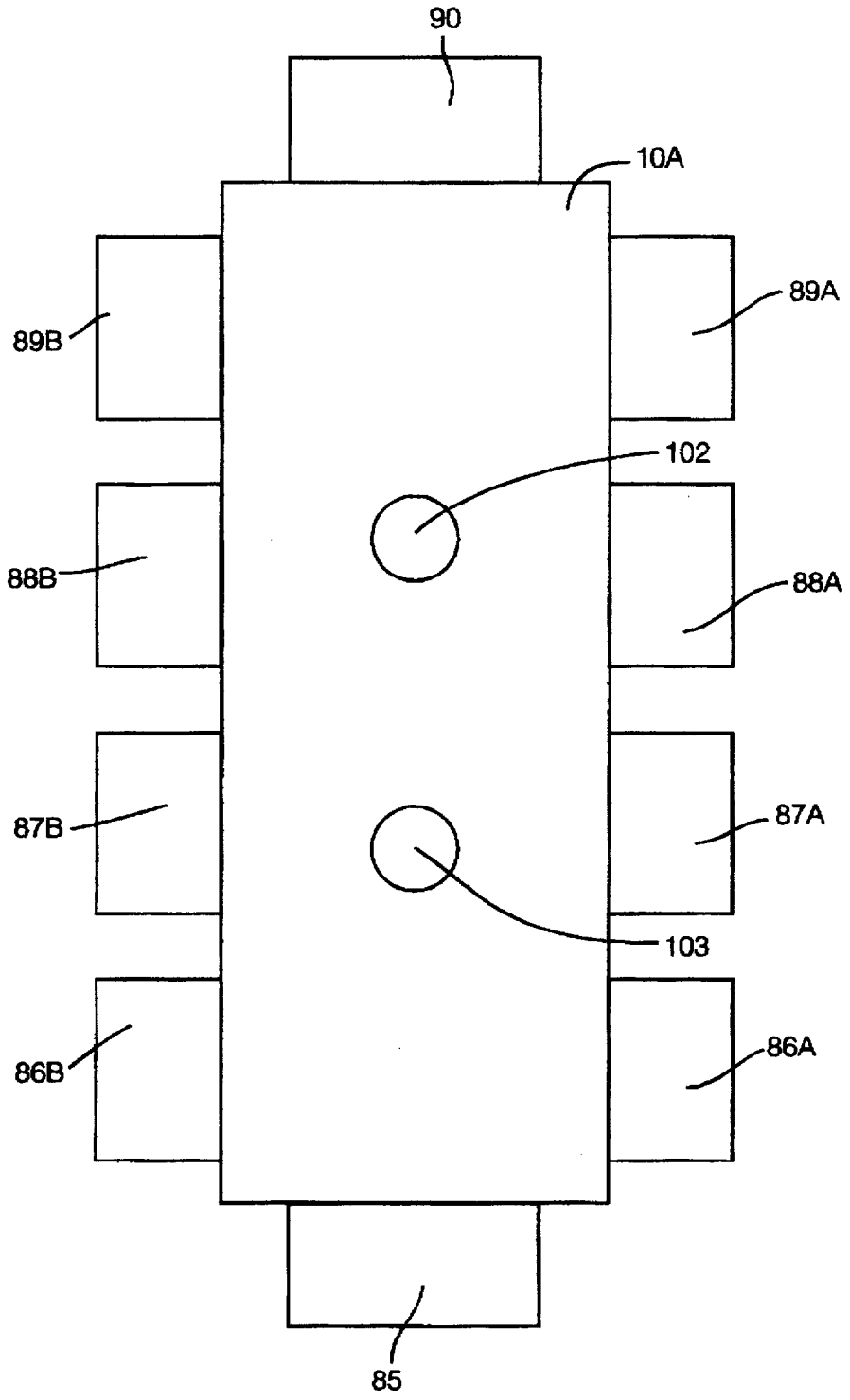
FIG. 7 is a bottom plan view of the interchangeable body panels support for the four door minivan.

The minivan in FIG. 6 is illustrated to show that with the same chassis 2 as in the FIG. 3, a different vehicle can be created. As shown in FIG. 6 the remote controlled toy crash vehicle includes the same chassis 2 on which are supported the axles of the front wheels 3A, 3B and the rear wheels 4A, 4B and a protruding front support 5 and a protruding rear support 6. The chassis 2 is provided with front left receptacle 8A which holds the front left turn signal lamp 7C, and with front right receptacle 8B which holds the front right turn signal lamp 7C, and with rear left receptacles which hold the rear left turn signal lamp/stop lamp 9C and the rear right turn signal lamp/stop lamp 9D. Temporarily mounted on the chassis 2 is the interchangeable body panels support 10A having a front bore 102 and a rear bore 103 which is shown in FIG. 7, and further comprising of a protruding front body panel support 90 with the mounting facet 80A to which is attached the front panel 70 via mounting facet 80B, protruding left fender support 89A with the mounting facet 96A to which is attached the left fender 71A via mounting facet 97B, protruding right fender support 89B with the mounting facet 98A to which is attached the right fender 71B via mounting facet 98B, protruding hood support 91 with the mounting facet 81A to which is attached the hood 75 via mounting facet 81B, protruding windshield support 92 with the mounting facet 82A to which is attached the windshield 76 via mounting facet 82B, protruding roof support 93 with the mounting facet 83A to which is attached the roof 77 via mounting facet 83B, protruding rear loading door support 85 with the mounting facet 84A to which is attached the rear loading door 78 via mounting facet 84B, protruding left front door support 88A with the mounting facet 96A to which is attached the left front door 72A via mounting facet 96B, protruding right front door support 88B with the mounting facet 99A to which is attached the right front door 72B via mounting facet 99B, protruding left rear door support 87A with the mounting facet 95A to which is attached the left rear door 73A via mounting facet 95B, protruding right rear door support 87B with the mounting facet 100A to which is attached the right rear door 73B via mounting facet 100B, protruding left quarter panel support 86A with the mounting facet 94A to which is attached the left quarter panel 74A via mounting facet 94B, and protruding right quarter panel support 86B with the mounting facet 101A to which is attached the right quarter panel 74B via mounting facet 101B. All of the aforementioned mounting facets either on the interchangeable body panels support 10A or on the panels may be covered with, but not limited to the following: adhesive, velcro, double sided tape etc.

The underside of the interchangeable body panels support 10A is shown in FIG. 7, with front bore 102 and rear bore 103, which affixes to chassis 2 via protruding front support 5 and protruding rear support 6 by means of friction, so designed that the necessary force required to change the interchangeable body panels support 10A does not exceed the force generated by a child. So the interchangeable body panels support 10A can be exchanged quickly and easily for an other interchangeable body panels support thus creating a new vehicle with the same chassis 2, and performing a different part in the educational traffic game. Further more the changeable body panels could be made of deformable materials such as, but not limited to the following: aluminum, alloys, plastic etc.

Figure 8:
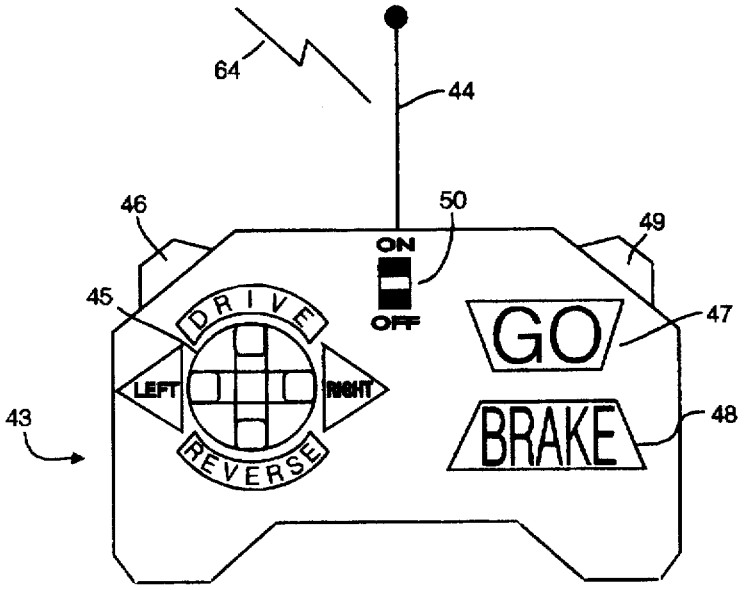
FIG. 8 shows a remote radio transmitter for controlling the toy crash vehicle depicted in FIG. 1.

In FIG. 8 the remote controlled toy crash vehicle 1 controlled by a remote control 43 having an antenna 44 for delivery of electromagnetic radio signals 64 to antenna 42 of the remote controlled toy crash vehicle 1. Remote control 43 has an on/off switch 50, a four way directional control 45 for controlling the forward/reverse and left/right motion of the remote controlled toy crash vehicle 1 and a brake pedal 48 for reducing the speed of, and stopping the remote controlled toy crash vehicle 1. In operation, selective activation of the four way directional control 45 when pressed in the drive direction together with gas pedal 47 pressed down delivers a signal over radio waves 64 to the antenna 42 which is received by the receiver which is housed inside the chassis 2, causes the remote controlled toy crash vehicle to move in the forward direction. The chassis 2 also contains all the necessary components (e.g. control unit, receiver/demodulator, signal processor, servo/actuator for controlling the left/right turn of the front wheels, servo/actuator for controlling a motor controller actuator for controlling the forward/reverse motion of the vehicle, servo/actuator for controlling the braking of the vehicle, a processor for controlling the left/right signaling and the brake lamp activation of the vehicle, and a frequency selector switch for changing the remote control frequency of the remote controlled toy crash vehicle in the event that more than one remote controlled toy crash vehicle is operated at the same time. (not shown)) required for the full operation of the remote controlled toy crash vehicle 1. The turning of the vehicle in the left or right directions is accomplished through the left/right selective activation of the four way directional control 45. This causes a second signal to be generated in radio signals 64 through antenna 42 to the receiver (housed in chassis 2, not shown) which causes the front wheel's servo actuators to turn the front wheels left or right, respectively. This briefly describes the operation of a model radio controlled vehicle. The right turn signal switch 49 and the left turn signal switch 46 when selectively activated causes a third and fourth signal to be generated respectively in radio signals 64 through antenna 42 to the receiver (housed in chassis 2) which causes the left front/rear turn signal lamps 7A, 106A or right front/rear turn signal lamps 7B, 106B to signal respectively. The brake pedal 48 when activated causes a fourth signal to be generated in radio signals 64 through antenna 42 to the receiver (housed in chassis 2) which causes the vehicle to slow down and eventually to stop in conjunction with the illumination of rear left stop lamp section 107A and rear right stop lamp section 107B, thus indicating to the other participants in the game that the remote controlled vehicle is slowing down or stopping. When two or more remote controlled toy crash vehicles are operated at the same time, the radio frequencies would have to be different to avoid any interference.

Figure 9:
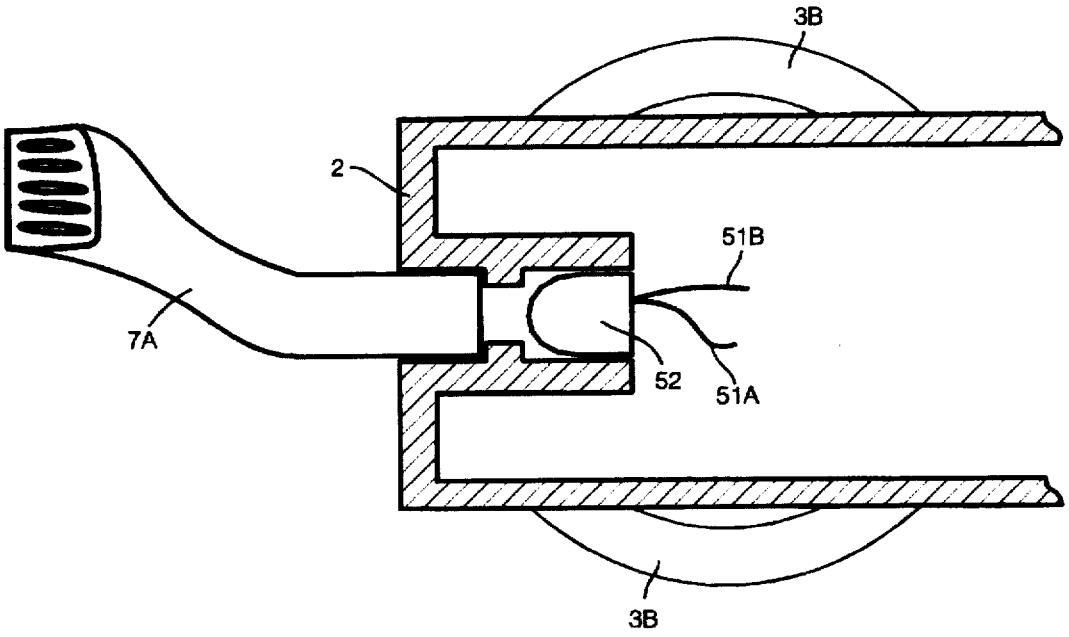
FIG. 9 is an enlarged cross sectional view taken on line 29—29 and looking in the direction of the arrows, particularly showing the signal lamp assembly.

FIG. 9 shows a cross section of the front left part of chassis 2 where the front left turn signal lamp 7A is housed through force of friction. The light bulb 52 which is also housed through force of friction is connected to the processing unit in chassis 2 via positive line 51A and negative line 51B. When the light bulb 52 is signaled it transfers the signaled light via translucent front left turn signal lamp 7A and indicates in conjunction with the rear left turn signal lamp/stop lamp 9A (only rear left turn signal section is lit up when signaling is indicated) to the other participants in the traffic game that the operator of this remote controlled toy crash vehicle is going to make a left turn.

Figure 10:
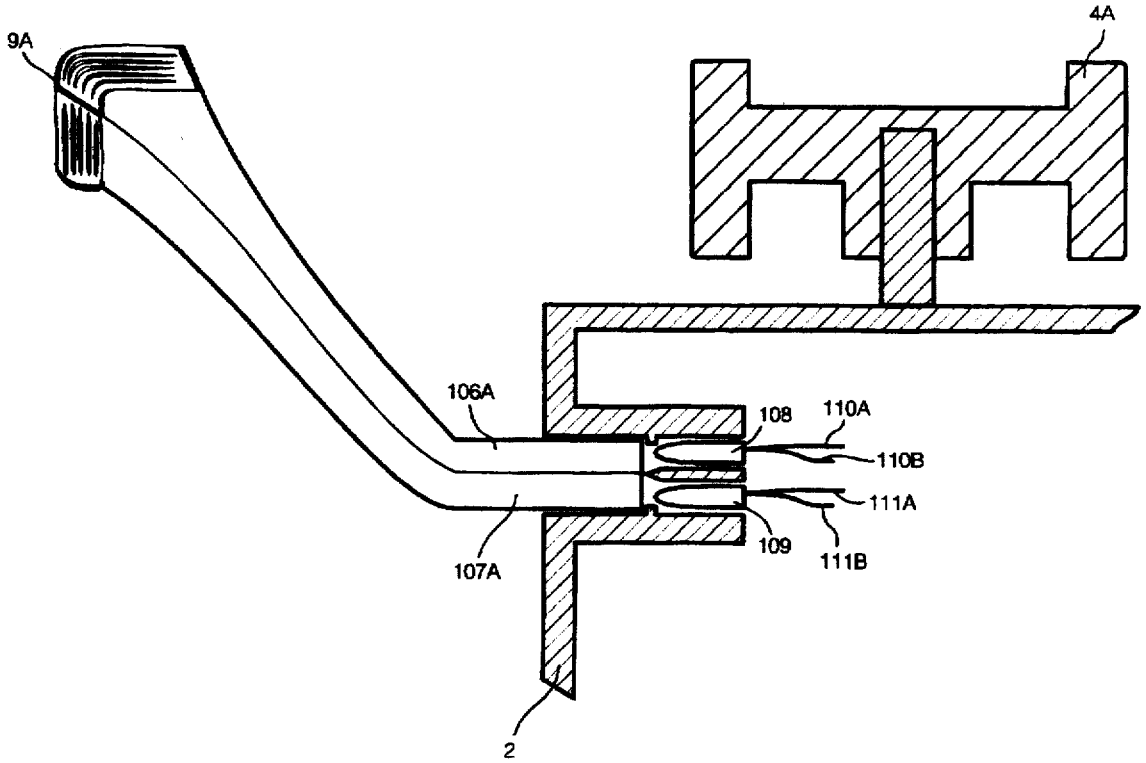
FIG. 10 is an enlarged cross sectional view taken on line 120—120 and looking in the direction of the arrows, particularly showing the rear left signal & stop lamp assembly.

FIG. 10 shows a cross section of the rear left part of chassis 2 where the rear left turn signal lamp/stop lamp 9A is housed through force of friction. The signaling light bulb 108 which is also housed through force of friction is connected to the processing unit in chassis 2 via positive line 110A and negative line 110B. When the signaling light bulb 108 is signaled it transfers the signaled light via translucent rear left turn signal lamp section 106A and indicates in conjunction with the front left turn signal lamp 7A (only rear left turn signal section is lit up when signaling is indicated) to the other participants in the traffic game that the operator of this remote controlled toy crash vehicle is going to make a left turn. When the remote control toy crash vehicle slows down or stops, simultaneously the stop light bulb 109 is activated and transfers the light via translucent rear left stop lamp section 107A and indicates for that duration to the other participants in the game that the remote control vehicle is slowing down or stopping. The rear left signal lamp section 106A is separated from rear left stop lamp section 107A by a coat of paint or some other material that will effectively seal the transmittal of light from one section to the other, thus eliminating the possibility of mixed signal being indicated to the other participants of the game.

Figure 11:
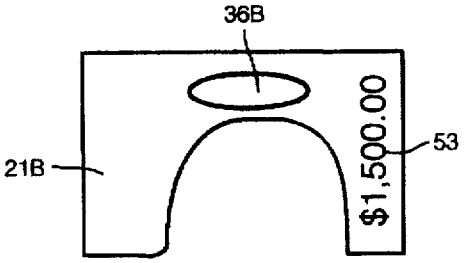
FIG. 11 is an inner side view of the right fender.

The inner side of right fender 21B as shown in FIG. 11 with mounting facet 36B has the cost of repairing the damage 53 imprinted on inner surface for the purpose of teaching the child or children the real cost of repairing the damaged part of the car.

Figure 12:
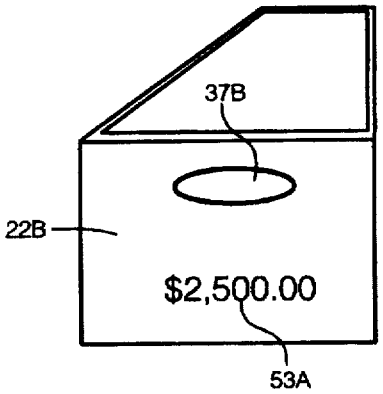
FIG. 12 is an inner side view of the right door.

FIG. 12 shows another example of the cost of repairing the damage 53A imprinted on the inner surface of right door 22B with mounting facet 37B. The examples in FIG. 11 and FIG. 12 represents what is printed on each and every body panel which can be damaged and needs replacement.

Figure 13:
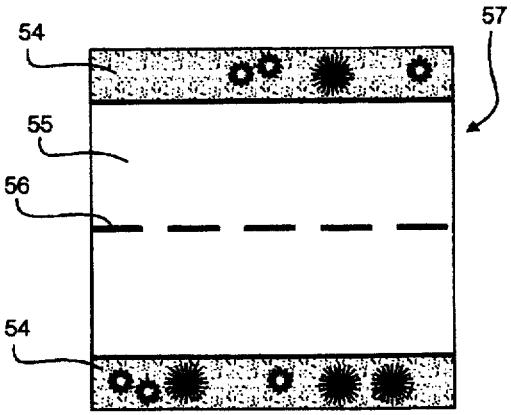
FIG. 13 is a plan view of a strait section segment.

A two way road segment as shown in FIG. 13 having a roadway 55, center striping 56, and landscapes 54 on each side of the segment.

Figure 14:
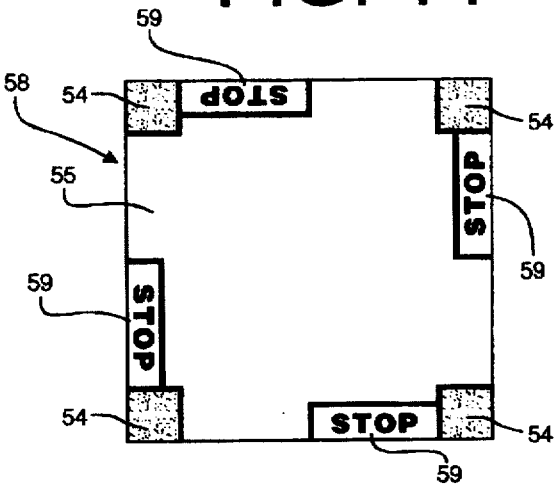
FIG. 14 is a plan view of a 4-way intersection segment.

A four way intersection segment as shown in FIG. 14 having a roadway 55, stop signs 59, and landscapes 54 in each corner.

Figure 15:
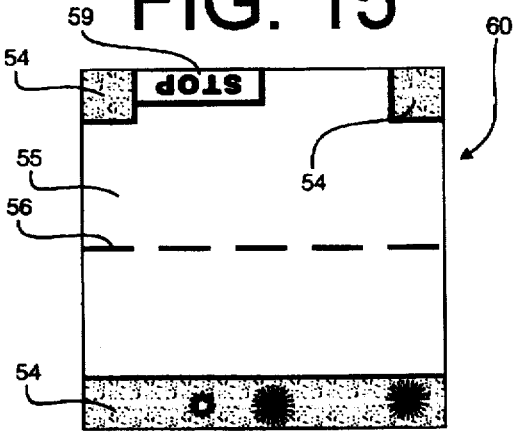
FIG. 15 is a plan view of a 3-way intersection segment.

FIG. 15 shows a three way intersection segment having roadway 55, center striping 56, landscapes 54, and stop sign 59.

Figure 16:
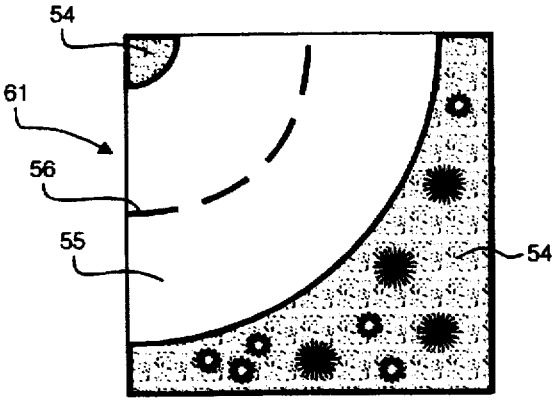
FIG. 16 is a plan view of a curve segment.

FIG. 16 show a curve segment having roadway 55, center striping 56, and landscapes 54 on each side.

Figure 17:
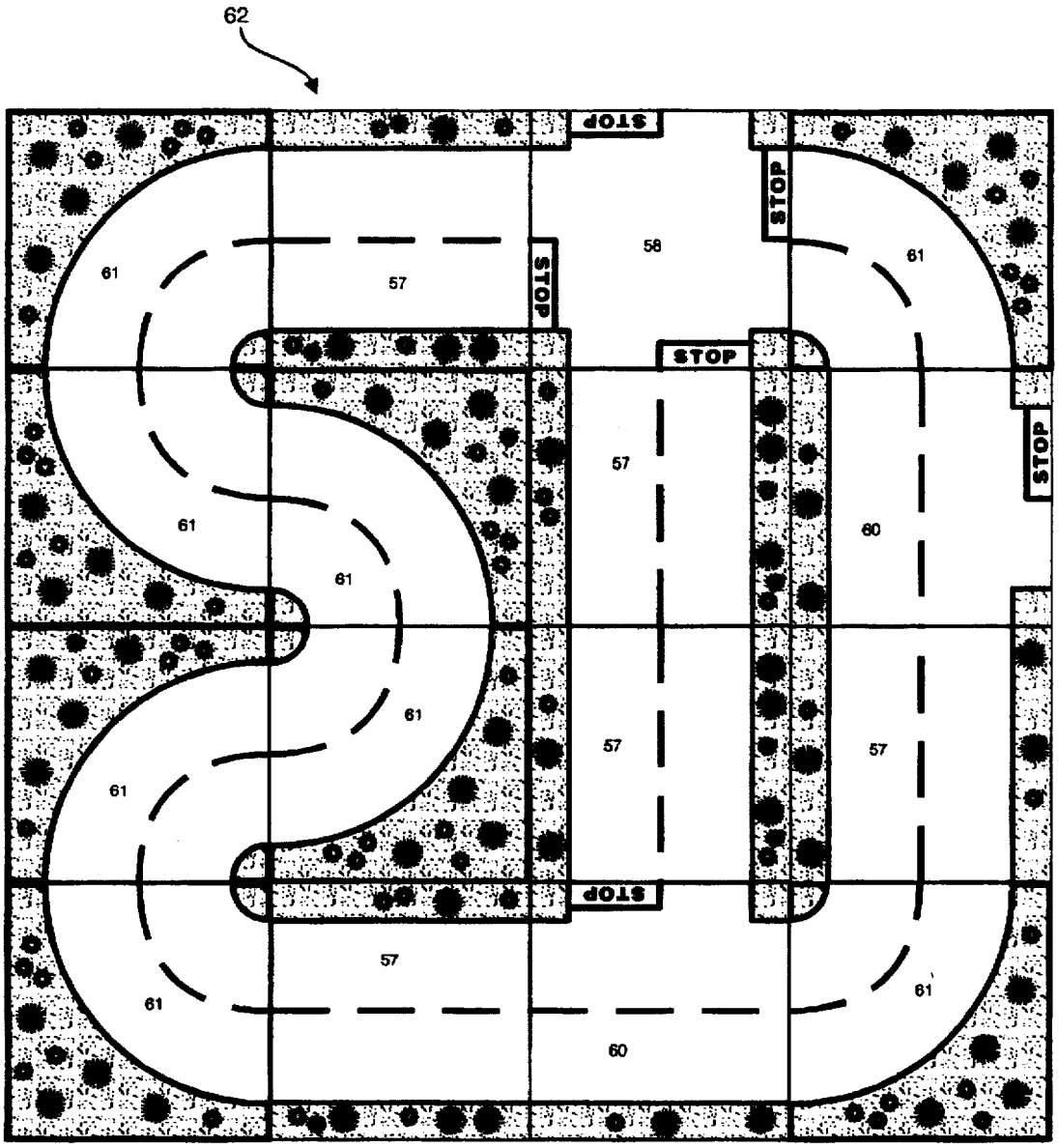
FIG. 17 is a plan view of FIGS. 13, 14, 15, 16 assembled in one of many different possible combinations.

All of the above mentioned road segments could be assembled into the possible combination 62 shown in FIG. 17, using one or more of the two way road segment 57, four way intersection segment 58, three way intersection segment 60, and the curve segment 61. The design possibility and size of area is only limited by the player's imagination.

Figure 18:
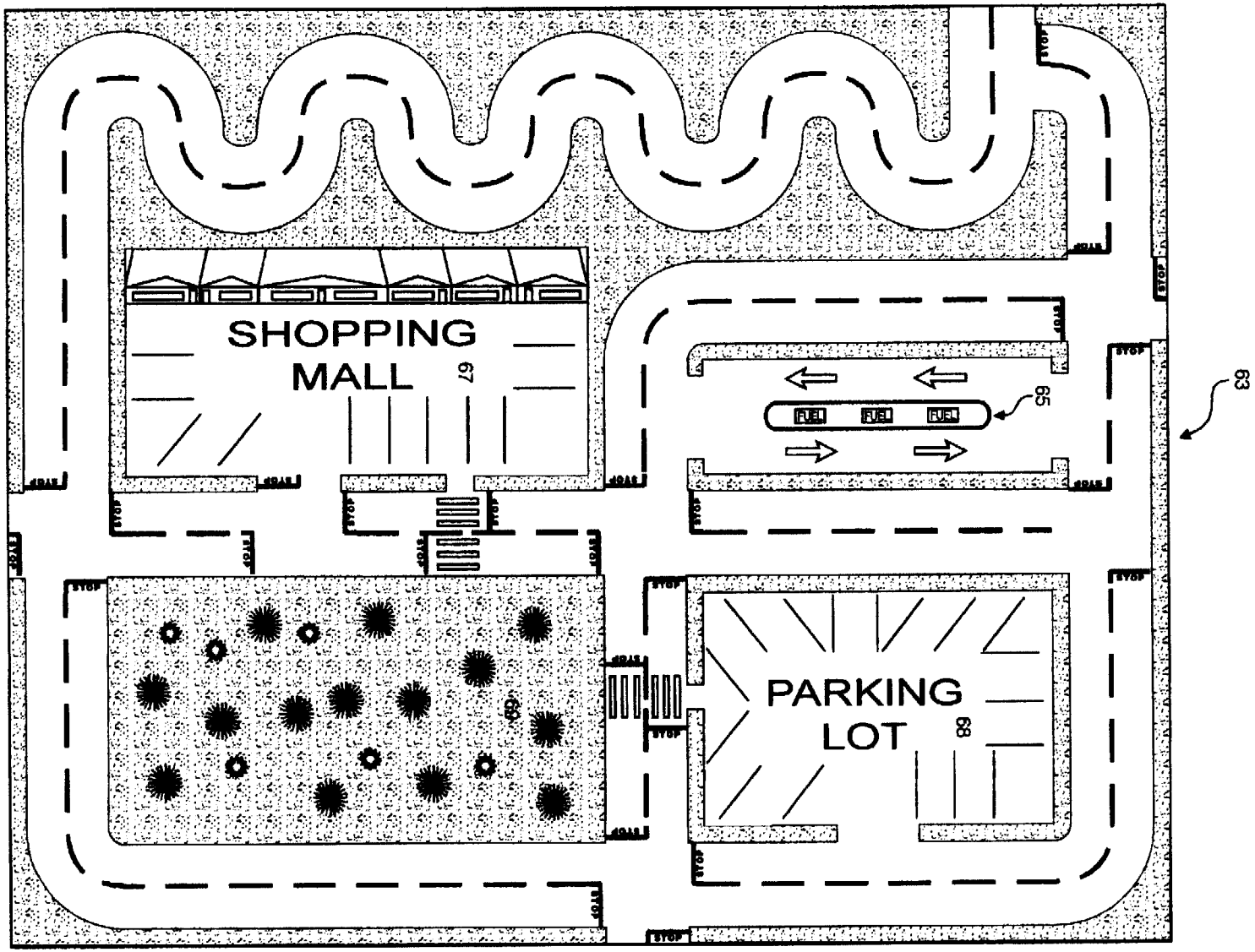
FIG. 18 is a plan view of permanent design possibility.

In FIG. 18 a permanent design possibility 63 is shown with a gas station 65, shopping mall 67, parking lot 68, and a park 69, with the necessary road signs imprinted on the road surfaces. The design possibilities could also include, but not limited to the following, post office, farm house, residential area, police station, fire station, hospital, fast-food restaurant, service station, and a speedway.

We claim:

1. A remote controlled toy crash vehicle apparatus comprising:

a remote controlled, wheeled chassis having internal light emitters and respective receptacles, a removable interchangeable member support upon said chassis, removable deformable interchangeable body members, removable interchangeable front optical turn signal member inserted into a receptable, removable interchangeable rear optical turn signal member having an optical stop signal member incorporated into said removable rear turn signal member which is inserted into a receptacle, said chassis, said removable interchangeable member support, said removable deformable interchangeable body members, said removable interchangeable front optical turn signal member, and said removable interchangeable rear optical turn signal member having an optical stop signal member incorporated, adapted to allow the body members to deform responsively upon impact.

2. A remote controlled toy crash vehicle apparatus as set forth in claim 1 further comprising of means for transmitting a left, right, forward, reverse, propel, brake command signals to the toy crash vehicle.

3. A remote controlled toy crash vehicle apparatus as set forth in claim 1 further comprising of means for transmitting a left turn signal indicating signal and a right turn signal indicating signal to said toy crash vehicle.

4. A remote controlled toy crash vehicle apparatus as set forth in claim 1 further comprising of removable deformable interchangeable body members having the estimated cost of reparation affixed to said removable deformable interchangeable body members.

5. A remote controlled toy crash vehicle apparatus as set forth in claim 1 further comprising of a plurality of different interchangeable roadway landscapes.

6. A remote controlled toy crash vehicle apparatus as set forth in claim 1 further comprising of a singular permanently printed roadway landscape.

* * * * *